United States Patent [19]

Gilbride et al.

[11] 4,449,463

[45] May 22, 1984

[54] FABRIC TENSIONING DEVICE

[75] Inventors: Andrew J. Gilbride, Swampscott; Edward S. Malecki, South Peabody; Edward H. Winslow, III, Beverly; Robert F. Coleman, Danvers, all of Mass.

[73] Assignee: USM Corporation, Farmington, Conn.

[21] Appl. No.: 348,460

[22] Filed: Feb. 12, 1982

[51] Int. Cl.[3] ..... D05B 21/00

[52] U.S. Cl. ..... 112/121.26

[58] Field of Search ..... 112/121.26, 121.27, 112/121.15, 305, 260, 86, 74

[56] References Cited

U.S. PATENT DOCUMENTS 3,980,030 9/1976 Fischer et al. ..... 112/121.15

4,066,026 1/1978 Hunt ..... 112/121.26

*Primary Examiner*—H. Hampton Hunter

*Attorney, Agent, or Firm*—Donald N. Halgren

[57] ABSTRACT

A fabric tensioning mechanism for pulling taut a flexible material arranged in a support frame, which frame is controllably movable in X-Y directions in a sewing machine setup. The fabric tensioning device is particularly useful to tension flimsy materials. A tensioning mechanism comprises several pivotable clamps arranged opposed one another across the support frame. The clamps are pivotable on the frame, and at least one clamp is movable with respect to the frame toward and away from its opposing clamp a regulatable distance to effect regulatable tension within any material pulled therebetween.

9 Claims, 5 Drawing Figures

FABRIC TENSIONING DEVICE

BACKGROUND OF THE INVENTION

1. Field of the Invention

This invention relates generally to sewing machines, and more particularly to material/fabric tensioning devices for those sewing machines.

2. Prior Art

The advent of computer controlled devices obviated the need for full manual operation of many crafts. One in particular is the stitching and embroidery art. The material being sewn is no longer guided in a convoluted path under the needle by hand, but is done so automatically, after being secured to a frame arrangement movable on the sewing machine base. The frame arrangement is movable in the horizontal X and Y directions due to engagement with computer controlled stepping motors, a frame arrangement being shown in U.S. Pat. No. 3,988,993, and assigned to USM.

This arrangement works well when the material being stitched is something heavy or thick, such as the denim patch-type pocket material of dungarees, or the like. Pattern stitching does not work well however, when the material is thin and flimsy, in which the material is pulled askew when the lower thread beneath the material is tensioned and pulls on the material, which yields or wrinkles, thus distorting the material and damaging the workpiece.

Thus, it is an object of the present invention, to eliminate the problems encountered when automatically stitching a pattern into fine or thin cloth like material.

It is a further object of this invention to be able to tension any web of material in a frame, which material is being stitched by a sewing machine.

It is yet a still further object of this invention, to provide a tension mechanism which can be regulated to tension a material a particular distance and then stop, and which allows the material to be tensioned with a high force that prevents any movement or shifting of the material by the action of the needle and also prevents overstretching of the material which would otherwise distort the final stitch pattern.

BRIEF SUMMARY OF THE INVENTION

The present invention comprises a material tensioning mechanism supported on a frame on a sewing machine. The frame rests on a table under the head of a sewing machine, the frame having a central portion which is cut-out and across which is stretched, the material to be stitched. The frame may be moved in a horizontal plane by computer controlled servo or stepping type motors.

A first pressurizable clamp is secured to one side of the frame, and is connected to an actuatable pressure source. A further pressurizable clamp is spaced across the cut-out on the other side of said frame and is arranged in a sliding relationship thereon. The further clamp is pivotally attached to the distal end of a piston rod of a motivated piston and cylinder arrangement which itself is secured to an extension of the frame. Actuation of the motivated piston and cylinder arrangement may cause the further clamp pivotally secured thereto, to move with respect to the frame and with respect to the first pressurizable clamp. When a piece of thin web-like material is placed over the cut-out of the frame, two of its opposing edges may be placed into the respective jaws of the then unactivated clamps. The clamps may be pressurized from a common source, and when both jaws are loaded the jaws may be closed simultaneously. Thereupon the motivated piston and cylinder may be pressurized to pull on the further clamp a prescribed distance outwardly, tensioning the material between the clamp jaws.

The further clamp is mounted on a bracket which has an arrangement of parallel keyways through which several keys on the frame may extend. The keys in the keyways provide the guidance and alignment to the further clamp as it is moved with respect to the frame to tension the material.

The motivated piston and cylinder arrangement has adjustment means to regulate the amount of travel of the piston within the cylinder. The adjustment means may comprise a set screw which is disposed in the distal end of the cylinder, which set screw is adjustable to control the travel of the head of the piston within the cylinder, thus concomitantly controlling the amount of longitudinal movement of the piston rod and the further clamp pivotally attached at the distal end thereof. The piston within the cylinder may have a ratchet thereattached which extends through the distal end of the cylinder, a pawl also pivotable at the distal end of the cylinder and engagable with the ratchet, to hold the advanced piston to a set distance of desired travel, preventing the material from yielding and distorting the pattern stitched therein.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
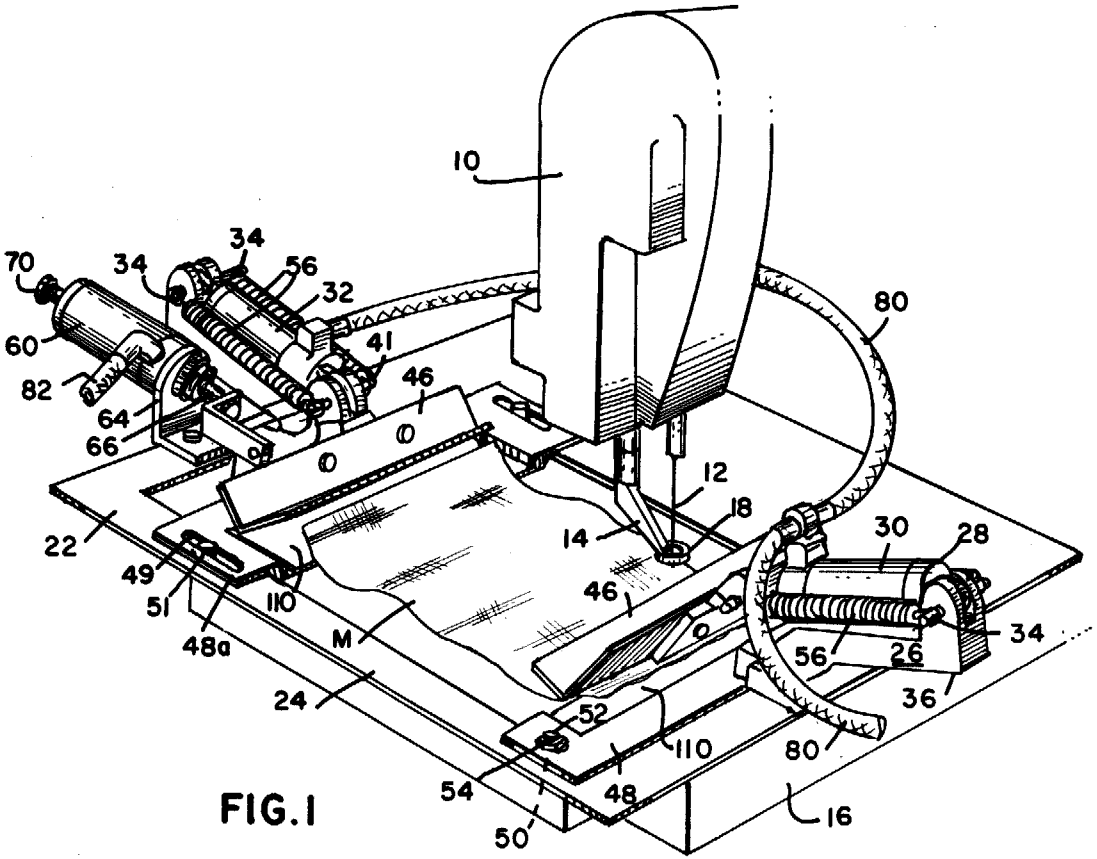
FIG. 1 is a perspective view of a sewing machine head mounted on a table having a frame with a clamping mechanism mounted thereon.

Referring to the drawings in detail, and particularly to FIG. 1, there is shown a sewing machine head 10, comprising a reciprocable threaded needle 12, a presser foot 14, each connected to proper mechanisms not shown, to effectuate their respective motions. The sewing machine head 10, is part of an overall sewing machine, not shown, which is mounted on a table or base 16.

The needle 12 in this embodiment, oscillates through an eye 18 on the distal end of the presser foot 14.

A workpiece supporting frame 22, is mounted for movement on the table 16 and such movement may be effectuated by several computer controlled servo or stepping type motors, not shown, which indexes the workpiece supporting frame 22 upon receipt of a proper signal from signal generating means, not shown.

Figure 2:
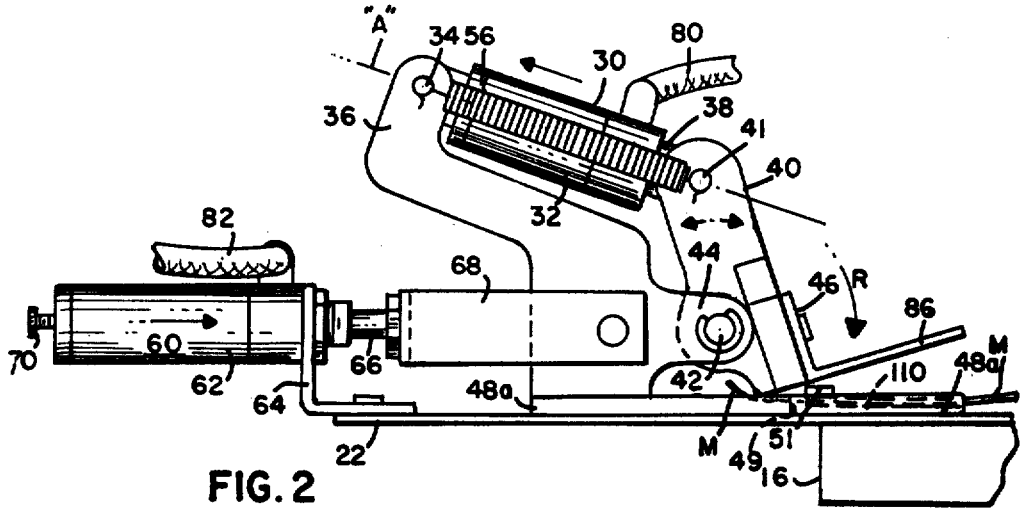
FIG. 2 is a side elevational view of the clamping mechanism in its opened state.

The frame 22 comprises a peripheral member 24 having a central "work area", which is cut-out therefrom. A first clamping means 26 is secured to one portion of the peripheral member 24, as shown in FIG. 1. The first clamping means 26 includes a biasing member 28 which preferably is a pressurizable piston and cylinder mechanism 30, and is preferably the same as that shown as a second clamping means 32 which will now be described. The piston and cylinder mechanism 30 is arranged so that the longitudinal axis may intersect the cut-out area of the frame 22. The longitudinal axis is designated "A" as shown in FIG. 2 on the second clamping means 32. The piston and cylinder mechanisms 30 comprising the first and second clamping means 26 and 32, is pivotally secured at one end, to a pin 34 which extends through the distal end of a support frame 36. The piston and cylinder mechanism 30 has a piston rod 38 which extends therefrom into pivotal contact with an axis 41 in the upper end of a clamping arm 40. The clamping arm 40 pivots about a pin 42 spaced at an intermediate location of the clamping arm 40, which pin 42 extends through tab 44 disposed adjacent the lower end of the support frame 36. A clamping bar 46 having an "L" shaped cross-section, is disposed on the outer lower end of the clamping arm 40, shown most clearly in FIG. 2.

The support frame 36 for the first clamping means 26 is is rigidly secured to a first mounting bracket 48. A pair of bolts 52 extend from the frame 2 and are in registration with a pair of holes 50 in the first mounting bracket 48 under the first clamping means 26, as shown in FIG. 1. A nut 54 comprises retainment means to secure the first mounting bracket 48 to the frame 22. The support frame 36 for the second clamping means 32 is secured to a second mounting bracket **48*a* is the same as the first mounting brack 48, except it has a pair of parallel keyways 49 therein, through which a pair of keys 51, disposed on the frame 22**, extend.

A contractive means 56, such as a spring or the like, may be disposed between the pin 34 at the distal end of each support frame 36, and the axis 41 in the upper end of each clamping arm 40.

Figure 3:
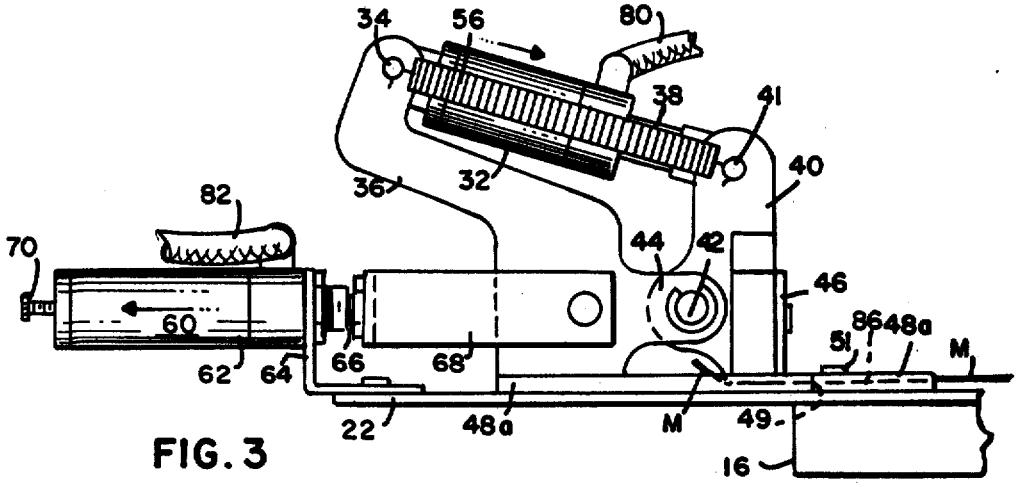
FIG. 3 is a view similar to FIG. 2 with the clamping mechanism shown in a closed state.

The second clamping means 32 may have a tension adjusting biasing means 60 thereon, which biasing means 60 comprises a pressurizable piston and cylinder mechanism 62 which is securely attached to the frame 22 by a bracket 64. A piston rod 66, extends from the piston and cylinder mechanism 62, and is attached to a yoke 68 that is bolted to the lower portion of the support frame 36 of the second clamping means 32, as shown in FIGS. 2 and 3. An adjustment member 70 may be disposed through the distal end of the cylinder in the piston and cylinder mechanism 62. A biasing means, not shown, such as a spring or the like, is arranged within the piston and cylinder mechanism 62 to effectuate an outwardly directed force on the piston rod 66, which direction is to the right as shown in FIG. 2.

The mounting bracket **48*a* for the second clamping means 32 is not tightly secured to the frame 22 as the mounting bracket 48 for the first clamping means 26 may be. It has the array of parallel keyways 49 which each receive the key 51 in registration therethrough, so as to permit relative motion between the second clamping means 32 and the frame 22** arranged on the table of the sewing machine.

The frame 22 is secured to several proper servo or stepping type motor mechanisms which are computer controlled to incrementally move the frame 22 with respect to the base 16 of the sewing machine, upon receipt of a proper signal, from a proper source, not shown.

The first and second clamping means 26 and 32 each receive pressurizable fluid from a proper source on receipt of a signal from a machine operator. The pressurizable fluid is transmitted through a conduit 80 arranged in fluid communication between the first and second clamping means 26 and 32, and a pressure generating means, not shown, actuatable by a proper signal. The tension adjusting biasing means 60 is also in fluid communication with the pressure generating means, through a conduit 82, to proper actuation and control means, not shown.

The preferred arrangement of the "L" shaped clamping bar 46 has a lower pressure plate 86 thereincluded, which are directed away from their respective piston and cylinder mechanisms 30, or tension adjusting biasing means 60, as shown in FIGS. 1, 2 and 3. The bottom surface of each lower pressure plate 86 may be treated with a friction increasing material to help its clamping action.

Figure 4:
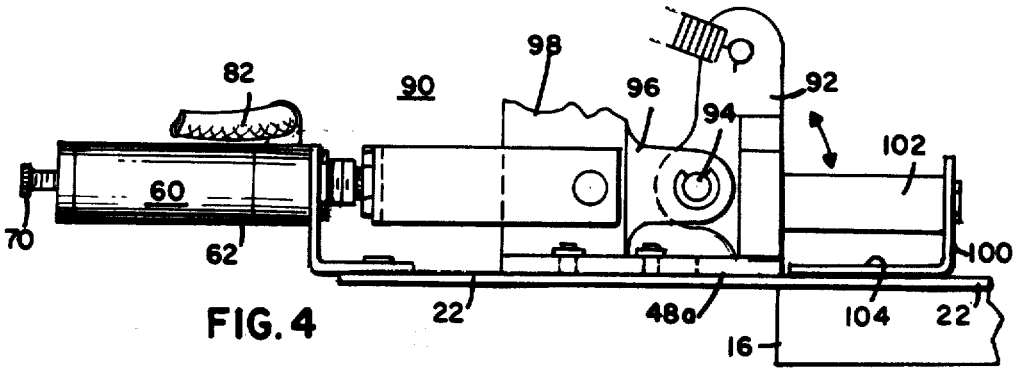
FIG. 4 is a view of an alternative embodiment of one of the clamping mechanisms.

An alternative arrangement is shown in FIG. 4, wherein a clamping means 90, is shown, mounted on the bracket **48*a* and arranged on the frame 22, in a manner similar to the second clamping means 32, having a clamping arm 92 pivotable about an axis 94 attached to a tab 96 on a support frame 98, and a clamping bar 100 of "L" shape in cross-section is mounted on a bracket 102 attached to the clamping arm 92, which clamping bar 100 has a pressure plate 104 directed inwardly towards the clamping arm 92 or the pressurized cylinders 60**.

Figure 5:
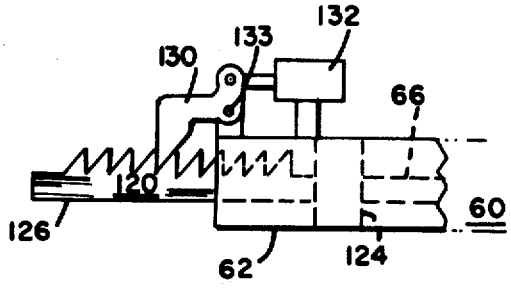
FIG. 5 is a view of a holding mechanism for the clamp.

A holding mechanism 120, is shown in FIG. 5 wherein the reciprocable biasing means 60 is partially shown with a piston 124 attached to the piston rod 66, and a ratchet 126 is attached to the other side of the piston 124, and extends through the cylinder 62. A pawl 130 is swingably arranged about an axis 133 and is attached to an actuation cylinder 132 secured to the cylinder 62, to provide a dimensional holding arrangement for the reciprocable biasing means 60.

In operation of the sewing machine, a piece or pieces of web-like material "M" to be stitched, shown in FIG. 1, is placed by a machine operator in a recess 110 on each bracket 48 and **48*a* beneath each clamping bar 46. A switch, not shown, is then activated by the operator, to cause pressurized fluid to be distributed to the piston and cylinder mechanisms 30 of the first and second clamping means 26 and 32. The clamping bar 46 is shown in its pre-pressurization mode in FIG. 2, the material "M" being disposed in the recess 110. The pressure through the conduit 80 causes the clamping bar 46, attached to the clamping arm 40 secured to the lower end of the now moving piston rod, to pivot clockwise about the pin 42, as shown by the arrow R in FIG. 2, each pressure plate 86 trapping its respective portions of the material M in the recess 110 in its respective brackets 48 or 48*a***.

The machine operator then may actuate a successive switch, not shown, which effectuates pressurization of the biasing means 60 through its associated conduit 82, to retract its piston and piston rod 66, therewithin. The reciprocable biasing means 60 is secured to the frame 22, and the piston rod 66 pulls on the yoke 68 to effectuate movement of the second clamping means with respect to the frame 22, by its being guided due to the slidable relationship of the keys 51 in their respective parallel keyways 49 in the bracket **48*a***.

The distance adjustment member 70 may comprise a threaded bolt arranged through the end of cylinder in the piston and cylinder mechanism 62, to act as an adjustable stop for the amount of travel of the piston, not shown in FIGS. 1–4, therewithin. Rotation of the bolt 70 may move it inwardly or outwardly to vary the abutment location between it and the piston therewithin. Thus the machine operator is able to put tension into material being clamped and sewn in a sewing machine, to prevent that material from shifting during stitching, which would otherwise produce irregularities therein, especially in thin material. The holding mechanism 120 shown in FIG. 5 may secure the clamping mechanism 32 with respect to the distance it has moved on the frame 22, keeping any material "M" tensioned thereby at a constant pull, preventing it from yielding due to action by the needle of the sewing machine. The actuation cylinder 132 may be energized by proper means, not shown, to release the ratchet 126, permitting the tension in the clamping means 32 associated therewith to be dissipated.

There is also an embodiment, which may combine the biasing means 60 by utilization of a reversed clamping bar 100. This embodiment utilizes the tensioning which occurs when the distal edge of the clamping plate 104 contacts the material M between it and the bracket 48, and pulls on it, thus causing the aforementioned tension.

The reversed clamping bar 100 may be utilized in conjunction with the biasing means 60, or be used by itself, and the biasing means 60 may be utilized on one or both clamping means 26 and 32, which if utilized on both clamping means 26 and 32, provides easier tensioning and more exact centering of material being worked.

Thus there has been shown arrangements by which thin material may be tensioned in a frame, which tensioning is regulatable by dimension, to prevent distorting of any material or threads in material being stitched in a sewing machine.

It is intended that the appended claims be interpreted in an exemplary manner, and not in a limiting sense.

We claim:

1. A mechanism for tensioning a web of material during stitching thereof by a sewing machine arranged on a work supporting base, said mechanism comprising:

a frame movably arranged on said supporting base;

an arrangement of clamping means disposed on said frame, adapted to secure said web of material to said frame;

a biasing means for moving at least one of said clamping means with respect to said frame to effectuate the tensioning of said web of material between said clamping means;

said clamping means comprising a clamping bar which is pivotable about a support axis to effect pressure against a bracket disposed on said frame; said clamping means being arranged on said bracket slidably disposed on said frame; and an adjustment means arranged with said biasing means to control the distance any material is being tensioned.

2. A mechanism for tensioning a web of material as recited in claim 1, wherein each of said clamping means has a biasing means associated therewith to effectuate movement with each biasing clamp with respect to said frame.

3. A mechanism for tensioning a web of material as recited in claim 1, wherein said clamping bar is actuated by a pressurizable piston and cylinder mechanism thereattached.

4. A mechanism for tensioning a web of material as recited in claim 2, wherein said biasing means is a pressurizable piston and cylinder mechanism.

5. A mechanism for tensioning a web of material as recited in claim 3, wherein said clamping bar is an "L" shaped member in cross-section, having a distal edge thereof directed generally away from said pressurizable piston and cylinder mechanism.

6. A mechanism for tensioning a web of material as recited in claim 3, wherein said clamping bar is an "L" shaped member in cross-section, having a distal edge thereof directed generally towards said pressurizable piston and cylinder mechanism.

7. A mechanism for tensioning a web of material as recited in claim 3, wherein all of said piston and cylinder mechanisms for actuating said clamping bars are pressurizable simultaneously.

8. A mechanism for tensioning a web of material as recited in claim 1, wherein said adjustment means comprises a threaded shaft arranged in said piston and cylinder mechanism to provide an abuttable limit to the distance of travel of the piston in said cylinder, thus providing a similar limit to the amount of travel of each clamping means with respect to said frame.

9. A mechanism for tensioning a web of material as recited in claim 1, wherein a ratchet member extends into said piston and cylinder mechanism, and a pawl is pivotable thereon on said piston and cylinder mechanism for registration with said ratchet member, to provide securable graduated distance control and holding power over said material being tensioned.

* * * * *